US009340960B2

(12) United States Patent
Xu

(10) Patent No.: US 9,340,960 B2
(45) Date of Patent: May 17, 2016

(54) DUAL FLUSH TOILET TRAP PRIMER

(76) Inventor: Hai Tao Xu, Xiamen (CN)

( * ) Notice: Subject to any disclaimer, the term of this patent is extended or adjusted under 35 U.S.C. 154(b) by 749 days.

(21) Appl. No.: 12/557,332

(22) Filed: Sep. 10, 2009

(65) Prior Publication Data

US 2011/0056009 A1 Mar. 10, 2011

(51) Int. Cl.
*E03D 1/14* (2006.01)

(52) U.S. Cl.
CPC ..... *E03D 1/142* (2013.01)

(58) Field of Classification Search
CPC ..... E03D 1/14; E03D 1/142; E03D 1/144; E03D 1/304; E03D 1/33; E03D 1/34; E03D 1/35; E03D 1/22; Y10T 137/7462
USPC ..... 4/324, 325, 415, 395, 396; 137/441, 137/434, 410, 426, 87.02, 120–122
See application file for complete search history.

(56) References Cited

U.S. PATENT DOCUMENTS 23,925 A * 5/1859 Lewis ..... 137/120
233,943 A * 11/1880 McLeod ..... 137/120
2,183,677 A * 12/1939 Heath ..... E03D 5/026 137/441
2,228,231 A * 1/1941 Hilliard ..... 218/103
4,764,998 A * 8/1988 Norris et al. ..... 4/502
5,341,520 A * 8/1994 Lazar ..... E03D 1/308 4/324
5,452,428 A * 9/1995 Nagata et al. ..... 712/211
5,452,482 A * 9/1995 Nichols-Roy ..... E03D 1/32 137/441
5,555,573 A 9/1996 Jensen
5,584,080 A * 12/1996 Nichols-Roy ..... E03D 1/32 4/324
5,594,959 A * 1/1997 Nichols-Roy ..... E03D 1/32 137/441
5,647,068 A * 7/1997 Jensen ..... E03D 1/33 4/325
5,661,855 A * 9/1997 Osmond ..... 4/415
5,699,563 A 12/1997 McClure
5,715,860 A 2/1998 Horad
5,862,537 A * 1/1999 Osmond ..... 4/415
8,117,687 B2 * 2/2012 Le ..... E03D 1/35 4/324
2006/0174403 A1 8/2006 Han
2010/0043131 A1 2/2010 Le et al.

* cited by examiner

*Primary Examiner* — Lauren Crane
*Assistant Examiner* — Erin Deery
(74) *Attorney, Agent, or Firm* — Isaac, Wiles, Burkholder & Teetor, LLC; Maribeth Melvch

(57) ABSTRACT

A trap primer for a dual flush toilet includes a housing having a water inlet port and both first and second outlet ports with the first outlet port being in fluid communication with a toilet bowl and the second outlet port being in fluid communication with a toilet tank. A float is disposed in the toilet tank and subject up and down motion due to a change in the water level in the toilet tank and a seesaw disposed in the housing enables flow of water from the inlet port alternatively to the first and second outlet ports through an arm interconnected with the float.

19 Claims, 4 Drawing Sheets

DUAL FLUSH TOILET TRAP PRIMER

The present invention generally relates to a toilet trap primer and is more particularly directed to a dual flush toilet trap primer.

Water-saving dual flush toilets are now in widespread use.

Such dual flush toilets compound the problem of water flow operation. Namely, the refill cycle after a full flush duration is greater than the partial flush duration and the volume of water dedicated to insuring that the toilet bowl trap is sealed is typically greater than the volume of water dedicated to resealing the trap during the partial cycle.

It is therefore possible to underfill the trap during consecutive partial flushes which can create a health hazard.

On the other hand, during a full flush, there may be an overfilled trap which wastes water that could have been better utilized, for example, with a full flush of 6 liters and a partial flush of 3 liters for a toilet, the amount of makeup water for a full flush is two times as much as that for a partial flush resulting in an excess of 50% of makeup water flowing into the sewer, which represents a severe waste of water resources.

The invention is intended to provide a dual flush toilet trap primer which remedies the defects of conventional technologies. It is simple, reliable, and enables the prevention of excess amounts of water flowing into the trap after a full flush and adjusts the makeup water to the trap thereby providing considerable economic and social benefits.

SUMMARY OF THE INVENTION

A trap primer for a dual flush toilet having a bowl and a tank with an overflow tube therein in accordance with the present invention generally includes a housing including a water inlet port, a first outlet port, and a second outlet port. The first outlet port is in fluid communication with the toilet bowl and the second outlet port is in fluid communication with the toilet tank.

A float is provided in the toilet tank and subject to up and down motion due to a change in water level in the toilet tank. A seesaw disposed in the housing enables water flow from the inlet port alternatively to the first and second outlet ports and an arm interconnects the seesaw and the float for operating the seesaw.

More particularly, the seesaw is pivotably mounted in a housing and includes a vane for directing water from the inlet port alternatively to one of the first and second outlet ports.

In another embodiment of the present invention, the seesaw includes seal rings proximate seesaw ends for alternatively sealing the first and second outlet ports.

A mounting ring is provided for fixing the housing to the overflow tube in a position orienting the first outlet port over the overflow tube for filling the toilet bowl and the second outlet port outside of the overflow tube for filling the tank.

Preferably the trap primer includes a float housing disposed in the toilet tank which encloses the float and a check valve in the float housing is provided for releasing water from the float housing upon the drop of water level in the toilet tank, thus causing downward motion of the float and movement of the arm and the vane to direct the water flow from the water inlet into the second outlet port to fill the toilet tank.

An adjustable float housing gate is provided for controlling entry of the water into the float housing at a selected water level in the toilet tank during filling of the toilet tank. Entry of water into the float housing past the gate causes floatation of the float and movement of the arm and the vane to direct water flow from the water inlet into the first outlet port to fill the toilet bowl.

In operation, before the toilet is flushed, water in the water tank is at a working level when the seesaw is positioned to enable the inlet port to be in fluid communication with the toilet, that is, the inlet port is in fluid communication with the first outlet port. After the toilet is fully flushed, water level in the water tank drops, and the fill valve begins feeding water, and the float begins to fall and drives the arm and seesaw to rotate, resulting in the inlet port in fluid communication with the second outlet port, that is, the inlet port is in fluid communication with the water tank. At this time, water fed into the cavity flows into the water tank from the second outlet port.

In the process of water feeding after the flush, water level rises in the water tank, and the float begins rise and drives the arm and seesaw to rotate, resulting in the inlet port to be in fluid communication with the first outlet port, that is, the inlet port is in fluid communication with the toilet. At this time, water flows into the toilet from the first outlet port as makeup.

As described, following the full flush, partial water flows into the water tank which otherwise would flow into the toilet in the absence of the trap primer, resulting in saving water.

The hereinabove description relates to full flush of a toilet. However, the toilet can be partially flushed in two ways.

In the first way, after the toilet is partially flushed, the water level falls in the water tank, and the fill valve begins feeding water, and the float falls and drives the swing arm and seesaw to rotate, resulting in the inlet port in fluid communication with the second outlet port, that is, the inlet port is in fluid communication with the water tank. At this time, water flows into the water tank from the second outlet port.

In the process of water feeding after the flush, water level rises in the water tank, and the float begins rise and drives the arm and seesaw to rotate, resulting in the inlet port in fluid communication with the first outlet port, that is, the inlet port is in fluid communication with the toilet. At the moment, water flows into the toilet from the first outlet port as makeup.

In this case, the toilet is partially flushed in the same way as fully flushed.

In the second way, following the partial flush, the water level in the water tank fails to fall enough to send down the float, equivalent to failure of the inlet port in fluid communication with the second outlet port, resulting in failure of switch over by the seesaw. As a result, water is always flowing to the toilet from the first outlet port as makeup.

As described, the toilet can be partially flushed in the first way or second way by adjusting position of the float on the arm.

A float housing is also provided for enclosing the float, and provided with a check valve at its bottom.

A dual flush toilet trap primer made in accordance with the present invention makes possible the amount of makeup water for full flush less than the amount of partial flush by providing a float housing for the float. When the water level in the water tank is lower than that in the reservoir, the check valve of the float housing will be activated and enable water to flow into the water tank. When the water level is higher than that in the float housing, the check valve will be shut off.

After the toilet is fully flushed, the water level falls in the water tank, and the fill valve begins feeding water while the water in the float housing flows into the water tank. The float falls and drives the aim and seesaw to rotate, resulting in the inlet port in fluid communication with the second outlet port, that is, the inlet port is in fluid communication with the water tank. At this time, water flows into the water tank from the second outlet port.

In the process of water feeding after the flush, water level rises in the water tank, and water does not flow into the float housing until the level becomes higher than an upper edge of the gate. The float begins rise and drives the arm and seesaw to rotate, resulting in the inlet port being in fluid communication with the first outlet port, that is, the inlet port is in fluid communication with the toilet. At this time, water flows into the toilet from the first outlet port as makeup.

In this way, the amount of makeup water for full flush will be less than that of partial flush.

The toilet can be partially flushed in the hereinabove described second way by adjusting the position of the trap primer upon installation.

Further, the side wall of the float housing is provided with an gate that adjusts height of an opening thereto and the switchover position of trap primer varies with position of the gate, making it possible to adjust the amount of makeup water for full flush as required.

Provided with a mounting ring, a dual flush toilet trap primer made in accordance with the present invention enables installation of the housing at a top of overflow tube in the water tank, and water flown out from the first outlet port to flow into the overflow tube, making it unnecessary to mount connecting tube between the outlet port and makeup water inlet for the toilet, and allowing for easy assembly.

BRIEF DESCRIPTION OF DRAWINGS

The advantages and features of the present invention will be better understood by the following description when considered in conjunction with the accompanying drawings in which.

DETAILED DESCRIPTION

Figure 1:
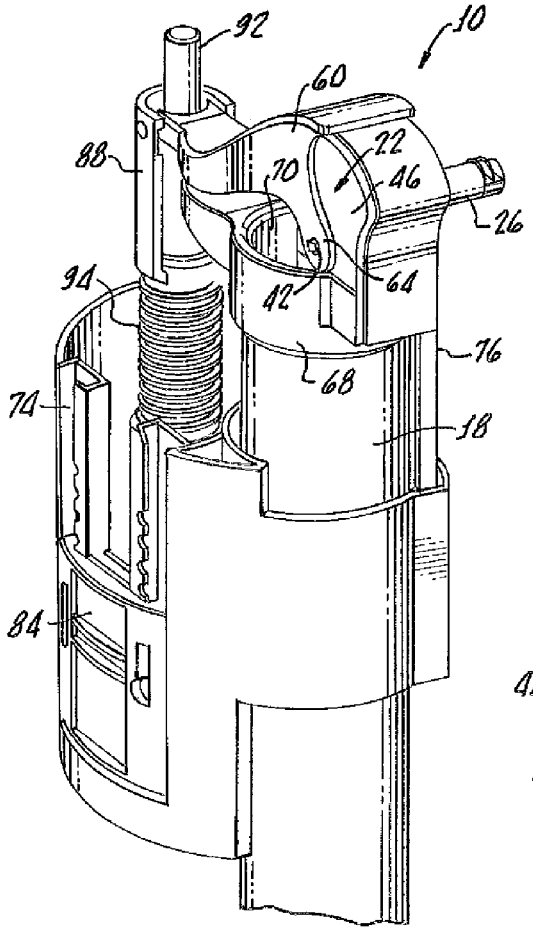
FIG. 1 is a perspective (one direction) schematic drawing of the embodiment 1 of the present invention.
Figure 2:
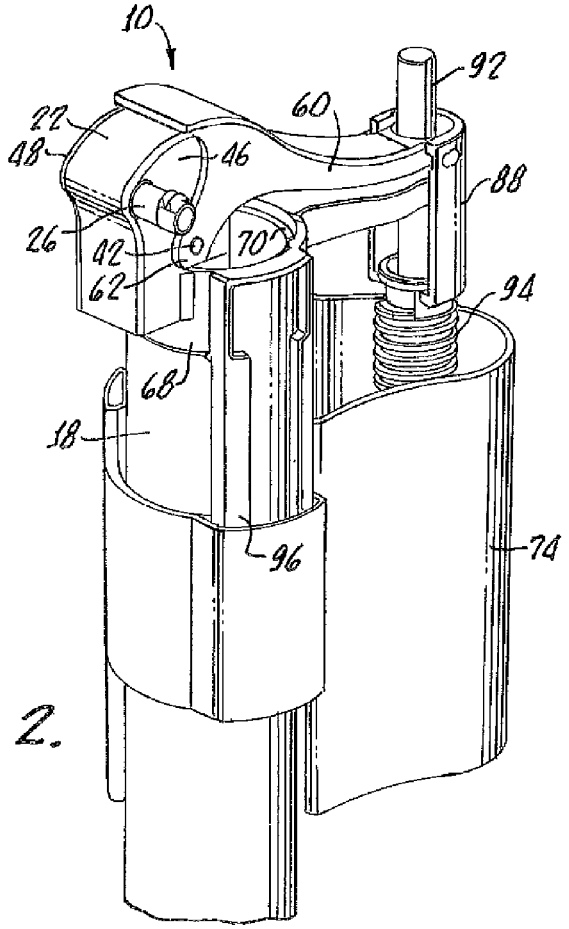
FIG. 2 is a perspective (another direction) schematic drawing of the embodiment 1 of the present invention.
Figure 3:
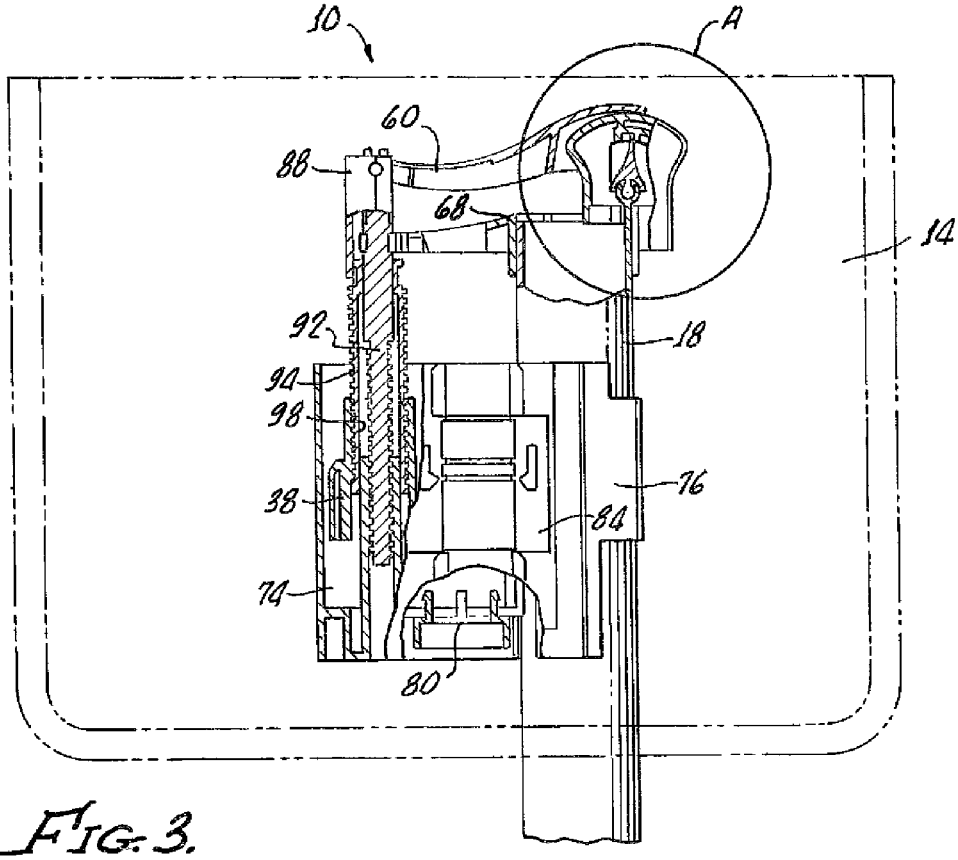
FIG. 3 is a schematic drawing (water flowing into a toilet) of the embodiment 1 of the present invention.
Figure 4:
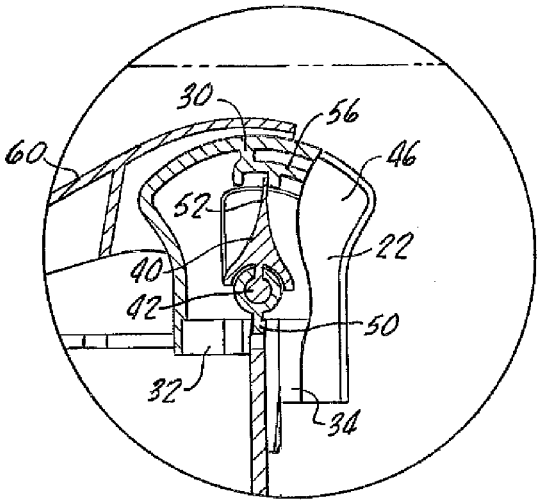
FIG. 4 is an enlargement view of Part A of FIG. 3.
Figure 5:
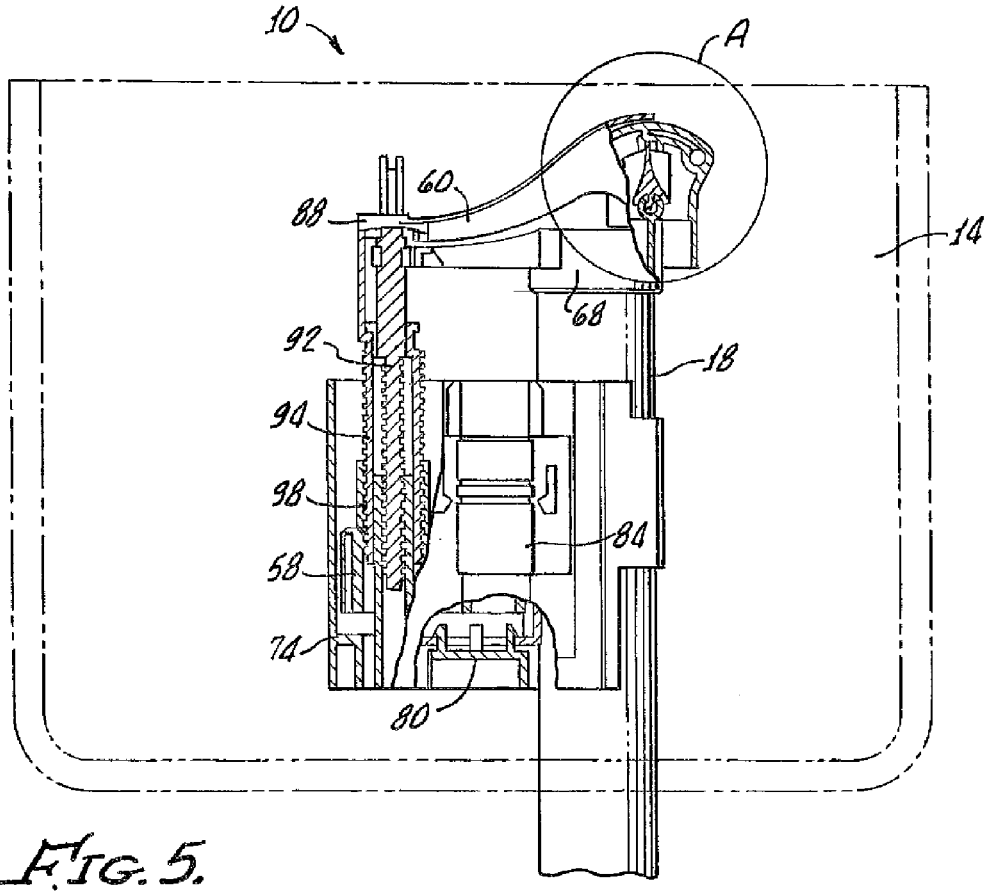
FIG. 5 is a schematic drawing (water flowing into a water tank) of the embodiment 1 of the present invention.

With reference to FIGS. 1-5, there is shown a trap primer 10 in accordance with the present invention for a dual flush toilet (not shown) having a bowl (not shown) and a tank 14 with an overflow tube 18, see FIGS. 3 and 5.

The housing 22 includes a water inlet 26, communicating with inlet port 30, and a first outlet port 32 and a second outlet port 34, see FIG. 4. The first outlet port is in fluid communication with the toilet bowl through the overflow tube 18 and a second outlet port is in direct fluid communication with the water tank 14 as shown in FIGS. 3 and 5.

With reference to FIGS. 3 and 5, a float 38 is disposed in the tank 10 which is subject to up and down motion due to a change of water level in the tank 10. A seesaw 40 is disposed within the housing 22 and supported by a shaft 42 extending between housing sides 46, 48, the shaft 42 in turn being held by a shaft support 50.

Figure 6:
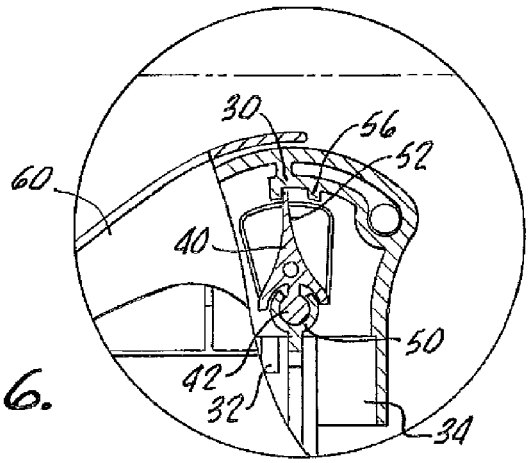
FIG. 6 is an enlargement view of Part B of FIG. 5.

A seesaw vane 52 is movable between two limiting walls 56 in order to direct water from the inlet port 30 to one of the first and second outlet ports 32, 34 as illustrated in FIGS. 4 and 6. A swing arm 60 is affixed to the shaft 42, for rotation thereof, by way of arm projections 62, 64 and is interconnected to the float 38 for enabling operation of the seesaw which includes rotating the vane 52 as illustrated in FIGS. 4 and 6.

A mounting ring 68 is utilized for fixing the housing 22 to a top 70 of the overflow tube 18 in a position which orients the first outlet port 32 over the overflow tube 18 for filling the toilet bowl, not shown, and a second outlet port 34 outside of the overflow tube 18 for filling the tank 14.

A reservoir is provided and disposed in the tank 14 for enclosing and floating the float 38, position of the float housing 74 relative to the overflow tube 18 being adjustable along a guide 76 as hereinafter described.

With reference to FIGS. 3 and 5, a check valve 80 in the float housing 74 releases water from the float housing 74 upon a drop of water level in the toilet tank 14 thus causing downward motion of the float 38 and movement of the arm 60 and the vane 52 to direct water flow from the water inlet 30 and to the second outlet port 32 to fill the toilet tank 14.

An adjustable float housing gate 84 is provided for controlling entry of water into the float housing 74, at a elected water level in the toilet tank 14 during filling of the toilet tank 14. Entry of water into the float housing 74 causes floatation of the float 38 and movement of the arm 60 and vane 52 to direct water from the water inlet port 30 into the first outlet port 32 to fill the toilet bowl.

The arm 60 is interconnected to the float 38 by way of a bushing 88, an inner screw 92 and an outer screw 94 engaging the float 38. This arrangement enables adjustment of the relative position between the float 38 and the arm 60.

In operation, for a full flush, when the drain valve, not shown, is activated for full flush, the water level falls in the water tank 14, the fill valve, not shown, turns on, the check valve 80 opens, and water level falls in the float housing 74, and float 38 falls in the float housing 74, driving the screw 94 and bushing 88 to move downward. The arm 60 then rotates the seesaw 40 counterclockwise. The reservoir vane 52 moves toward the left limiting wall 56, and water feeding into said inlet port 30 flows into the second outlet port 34, and into the water tank 14. This process does not stop until the flush is completed.

In the process of water feeding, water level rises in the water tank 14 and the check valve 80 shuts. Water in the tank 14 does not flow into the float housing 74 until the level becomes higher than the gate 84. The float 38 begins rise and drives the screw 94 and bushing 88 to move upward. The arm 60 then rotates the seesaw 40 clockwise. The seesaw vane 52 moves toward the right limiting wall 56, and water feeding into said inlet port 30 flows into the first outlet port 32, and into the overflow tube 18 as makeup.

A switchover position of trap primer varies with position of the gate 84, making it possible to adjust the amount of makeup water for the full flush as required.

The toilet can be partially flushed in two ways.

In a first way, when the toilet is partially flushed, the trap primer 10 is designed to work in same way as for fall flush. In such working condition, the amount of makeup water for full flush is consistent with that for partial flush, and the amount of makeup water can be adjusted.

The trap primer 10 can also work in a second way as follows:

Following a partial flush after the drain valve is activated, the water level falls in the water tank 14, the fill valve turns on, and the check valve 80 opens, and water level falls in the float housing 74 accordingly. The water level in the tank 14 fails to reach the position to make the seesaw 40 swing, and upper end of the seesaw 40 is always moving toward the right limiting wall 56; water feeding to the inlet port 30 flows along one side of the vane 52 into the first outlet port 32, and then into the overflow tube 18 as makeup till the end of water feeding. In such working condition, the amount of makeup water for full flush and partial flush is same, or the amount of makeup water for full flush is less than the amount of partial flush.

The water feeding can be adjusted by adjusting the position of the float 38 or the whole trap primer 10 thereby making it possible to switch over between the two ways of partially flushing.

The trap primer 10 made in accordance with the present invention is provided with the mounting ring 68, enabling said housing 32 to be installed at the top 70 of the overflow tube 18 in the water tank 14, and the first outlet port 32 of said housing 22 is in fluid communication with the overflow tube 18, which makes it unnecessary to mount any connecting tube, not shown, between the outlet port 32 and makeup water inlet for the toilet, and allowing for easy assembly. However, the mounting ring 68 is optional, and the housing 22 can also be mounted in the water tank 14 in any other suitable fashion.

As hereinabove described, the trap primer made in accordance with the present invention is provided with screws 92, 94 and bushing 88, with an end of the swing arm 60 connected with the float 38 via the bushing 88, and screw 94. The screws 94, 92, position of the float 38, and float housing 74 for simultaneous adjustment and easy use. However, screws 92, 94 and bushing 88 are optional. The end of the swing arm 60 can be directly connected with the float 38 if desired. Also, the float housing 74 allows for consistency of the amount of makeup water for full flush and partial flush, and adjustment of the amount or the amount of makeup water for the full flush being less than the amount of partial flush.

As hereinabove described, the trap primer 10 made in accordance with the present invention is provided with float housing 74 in which the float 38 is contained. However, the float housing 74 is optional. The float 38 can be mounted in the water tank 14, and also allows for consistency of the amount of makeup water for full flush and partial flush, and adjustment of the amount of makeup water.

Figure 7:
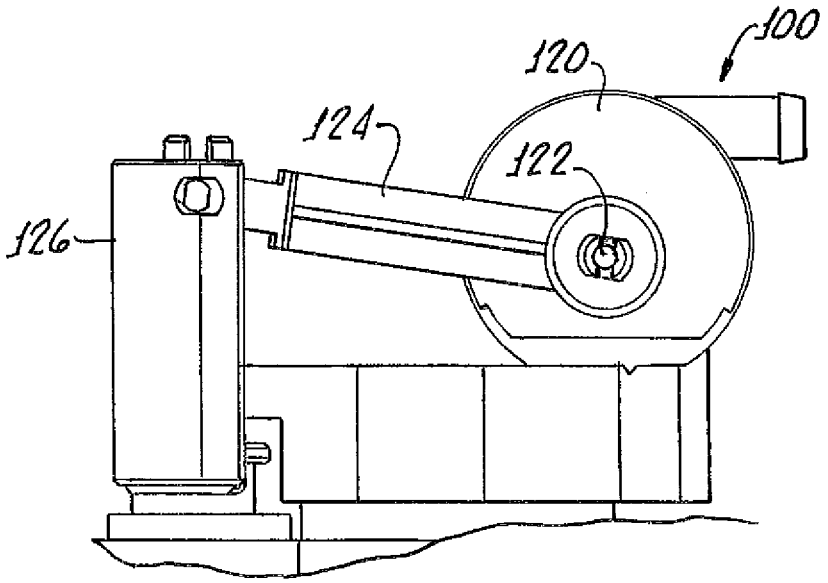
FIG. 7 is a partial schematic drawing of a second embodiment of the present invention.
Figure 8:
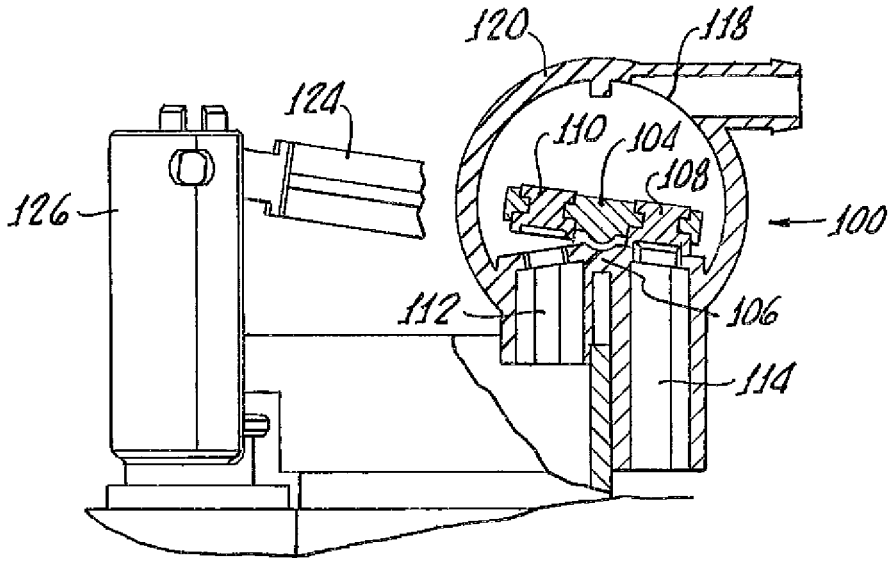
FIG. 8 is a partial sectional view of the second embodiment of the present invention.

With reference to FIGS. 7 and 8, there is shown another embodiment 100 of a trap primer in accordance with the present invention illustrating a seesaw 104 disposed for rocking on a shaft support 106 and having seal rings 108, 110 for alternately sealing a first outlet port 112 and a second outlet port 114 for selectively diverting water through an inlet port 118 in a housing 120.

A shaft interconnected with the seesaw 104 is operated through an arm 124 interconnected with a bushing 126 for operation with the float 38, not shown, in FIGS. 7 and 8 in a manner identical to that as described in connection with the trap primer 10.

Although there has been hereinabove described a specific dual flush toilet trap primer in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A trap primer for a dual flush toilet having a bowl and a tank with an overflow tube therein, said trap primer comprising:

a housing including a water inlet port, a first outlet port, and a second outlet port and two limiting walls, said first outlet port being in fluid communication with the toilet bowl and said second outlet port being in fluid communication with the toilet tank;

a float disposed in a float housing, said float housing disposed in the toilet tank and said float subject to up and down motion due to a change of water level in the toilet tank;

a seesaw disposed in said housing for enabling flow of water from the inlet port alternatively into the first and second outlet ports and including a vane; said vane being movable between said two limiting walls, wherein when said vane moves toward one of said two limiting walls, said seesaw directs water from said water inlet port to one of said first and second outlet ports; and when said vane moves toward the other one of said two limiting walls, said seesaw directs water from said water inlet port to the other one of said first and second outlet ports;

an arm, operatively interconnected between said seesaw and said float, for operating said seesaw, wherein said arm is operatively connected to the seesaw such that movement of said arm moves said vane of said seesaw between said two limiting walls, wherein said arm is operatively connected to said float such that up and down movement of said float moves said arm to move said vane of said seesaw between said two limiting walls, a mounting ring for fixing said housing to a top of the overflow tube in a position orienting said first outlet port over the overflow tube for filing the toilet bowl and said second outlet port outside of the overflow tube for filling the toilet tank; and a check valve in said float housing for releasing water from the float housing upon a drop in water level in the toilet tank causing downward motion of said float and movement of said arm and said vane to direct water flow from the water inlet port into said second outlet port to fill the toilet tank.

2. The trap primer according to claim 1 wherein said seesaw is pivotably mounted in said housing.

3. The trap primer according to claim 1 further comprising an adjustable float housing gate for controlling entry of water into the float housing at a selected water level in the toilet tank during filling of the toilet tank, entry of water into the float housing causing floatation of said float and movement of said arm and said vane to direct water flow from the water inlet port into said first outlet port to fill the toilet bowl.

4. The trap primer according to claim 1 further including a bushing and a screw, wherein said bushing is operatively connected to said screw and said bushing, wherein said screw engages said float.

5. The trap primer according to claim 1 further including a bushing, an inner screw, and an outer screw, wherein said inner screw is surrounded by said outer screw and threadily connected to said outer screw, wherein said outer screw engages said float, wherein said arm is operatively connected with the float via said bushing and said outer screw.

6. A trap primer for a dual flush toilet having a bowl and a tank with an overflow tube therein, the trap primer comprising:

a housing including a water inlet port, a first outlet port, and a second outlet port and two limiting walls, the first outlet port being in fluid communication with the toilet bowl and the second outlet port being in fluid communication with the toilet tank;

a float disposed in a float housing, the float housing disposed in the toilet tank and the float subject to up and down motion due to a change of water level in the toilet tank;

a seesaw disposed in the housing for enabling flow of water from the inlet port alternatively into the first and second outlet ports and including a vane; the vane being movable between the two limiting walls, wherein when the vane moves toward one of the two limiting walls, the seesaw directs water from the water inlet port to one of the first and second outlet ports; and when the vane moves toward the other one of the two limiting walls, the seesaw directs water from the water inlet port to the other one of the first and second outlet ports;

an arm, operatively interconnected between the seesaw and the float, for operating the seesaw, wherein the arm is operatively connected to the seesaw such that movement of the arm moves the vane of the seesaw between the two limiting walls, wherein the arm is operatively connected to the float such that up and down movement of the float moves the arm to move the vane of the seesaw between the two limiting walls; and a check valve in the float housing for releasing water from the float housing upon a drop in water level in the toilet tank causing downward motion of the float and movement of the arm and the vane to direct water flow from the water inlet port into the second outlet port to fill the toilet tank.

7. The trap primer according to claim 6 wherein the seesaw is pivotably mounted in the housing.

8. The trap primer according to claim 6 further comprising an adjustable float housing gate for controlling entry of water into the float housing at a selected water level in the toilet tank during filling of the toilet tank, entry of water into the float housing causing floatation of the float and movement of the arm and the vane to direct water flow from the water inlet port into the first outlet port to fill the toilet bowl.

9. The trap primer according to claim 6 further including a bushing and a screw, wherein the bushing is operatively connected to the screw and the bushing, wherein the screw engages the float.

10. The trap primer according to claim 6 further including a bushing, an inner screw, and an outer screw, wherein the inner screw is surrounded by the outer screw and threadily connected to the outer screw, wherein the outer screw engages the float, wherein the arm is operatively connected with the float via the bushing and the outer screw.

11. A trap primer for a dual flush toilet having a bowl and a tank with an overflow tube therein, the trap primer comprising:

a housing including a water inlet port, a first outlet port, and a second outlet port and two limiting walls, the first outlet port being in fluid communication with the toilet bowl and the second outlet port being in fluid communication with the toilet tank;

a float disposed in a float housing, the float housing disposed in the toilet tank and the float subject to up and down motion due to a change of water level in the toilet tank;

a seesaw disposed in the housing for enabling flow of water from the inlet port alternatively into the first and second outlet ports;

an arm, operatively interconnected between the seesaw and the float, for operating the seesaw, wherein the arm is operatively connected to the seesaw such that movement of the arm moves the seesaw to enable flow of water from the inlet port alternatively into the first and second outlet ports, wherein the arm is operatively connected to the float such that up and down movement of the float moves the arm to move the seesaw to enable flow of water from the inlet port alternatively into the first and second outlet ports; and a check valve in the float housing for releasing water from the float housing upon a drop in water level in the toilet tank causing downward motion of the float and movement of the arm and the seesaw to direct water flow from the water inlet port into the second outlet port to fill the toilet tank.

12. The trap primer according to claim 11 wherein the seesaw is pivotably mounted in the housing.

13. The trap primer according to claim 11 further including a bushing and a screw, wherein the bushing is operatively connected to the screw and the bushing, wherein the screw engages the float.

14. The trap primer according to claim 11 further including a bushing, an inner screw, and an outer screw, wherein the inner screw is surrounded by the outer screw and threadily connected to the outer screw, wherein the outer screw engages the float, wherein the arm is operatively connected with the float via the bushing and the outer screw.

15. The trap primer according to claim 11 further comprising a mounting ring for fixing the housing to a top of the overflow tube in a position orienting the first outlet port over the overflow tube for filing the toilet bowl and the second outlet port outside of the overflow tube for filing the toilet tank.

16. The trap primer according to claim 11 further comprising an adjustable float housing gate for controlling entry of water into the float housing at a selected water level in the toilet tank during filling of the toilet tank, entry of water into the float housing causing floatation of the float and movement of the arm and the seesaw to direct water flow from the water inlet port into the first outlet port to fill the toilet bowl.

17. The trap primer according to claim 16 wherein the check valve is configured to shut such that water in the toilet tank does not flow into the float housing until the water level in the toilet tank reaches the selected water level.

18. The trap primer according to claim 11 wherein the seesaw is pivotably mounted in the housing and includes seal rings, proximate seesaw ends, for alternatively sealing the first and second outlet ports.

19. The trap primer according to claim 18 further comprising a mounting ring for fixing the housing to a top of the overflow tube in a position orienting the first outlet port over the overflow tube for filing the toilet bowl and the second outlet port outside of the overflow tube for filling the toilet tank.

* * * * *